US005549081A

United States Patent [19]

Ohlendorf et al.

[11] Patent Number: 5,549,081

[45] Date of Patent: Aug. 27, 1996

[54] ARRANGEMENT FOR OPERATING VALVES OF AN INTERNAL COMBUSTION ENGINE

[75] Inventors: Rolf Ohlendorf, Weinstadt; Hans-Jürgen Strauber, Stuttgart; Rainer Aust, Böblingen; Wolfgang Strobel, Remshalden, all of Germany

[73] Assignee: Mercedes-Benz AG, Stuttgart, Germany

[21] Appl. No.: 561,112

[22] Filed: Nov. 20, 1995

Related U.S. Application Data

[63] Continuation of Ser. No. 334,927, Nov. 7, 1994, abandoned.

[30] Foreign Application Priority Data

Nov. 8, 1993 [DE] Germany ..... 43 38 050.6

[51] Int. Cl.[6] ..... F01L 1/18; F02D 13/02

[52] U.S. Cl. ..... 123/90.16; 123/90.39

[58] Field of Search ..... 123/90.15, 90.16, 123/90.17, 90.27, 90.39, 90.41, 90.44; 251/251

[56] References Cited

U.S. PATENT DOCUMENTS

| | | | |
|---|---|---|---|
| 4,768,475 | 9/1988 | Ikemura | 123/90.16 |
| 4,911,112 | 3/1990 | Oikawa et al. | 123/90.16 |
| 4,926,804 | 5/1990 | Fukuo | 123/90.16 |
| 5,042,437 | 8/1991 | Sakuragi et al. | 123/90.16 |
| 5,207,193 | 5/1993 | Sugimoto et al. | 123/90.16 |
| 5,301,636 | 4/1994 | Nakamura | 123/90.16 |

FOREIGN PATENT DOCUMENTS

| | | |
|---|---|---|
| 0323234 | 7/1989 | European Pat. Off. . |
| 0343931 | 11/1989 | European Pat. Off. . |
| 0265281 | 8/1990 | European Pat. Off. . |
| 0293209 | 11/1991 | European Pat. Off. . |
| 4204048 | 1/1993 | Germany . |
| 4221134 | 7/1993 | Germany . |

*Primary Examiner*—Weilun Lo
*Attorney, Agent, or Firm*—Klaus J. Bach

[57] ABSTRACT

In an arrangement for operating valves of an internal combustion engine by means of at least two operating members for opening and closing each valve and a camshaft with cams having base portions and camming portions for operating the operating members wherein the operating members for a valve are disposed in side-by-side relation and have guide bores which are aligned when the operating members are disposed on the base portions of the cams and a coupling pin is movable in the guide bores and couples the adjacent operating arms when disposed so as to extend thereacross for movement of said adjacent operating members in unison, the coupling pin is barrel-shaped wife tapered end sections and a center section of a larger diameter which, with the guide bores of the adjacent operating members, forms a cylindrical fit with a clearance of 1–60 μm.

8 Claims, 5 Drawing Sheets

ARRANGEMENT FOR OPERATING VALVES OF AN INTERNAL COMBUSTION ENGINE

This application is a continuation, of application Ser. No. 08/334,927, filed Nov. 7, 1994, now abandoned.

BACKGROUND OF THE INVENTION

The invention relates to an arrangement for operating valves of an internal combustion engine by means of several cams and several rocker arms which are disposed adjacent to one another and can be joined or disconnected by a control pin axially movable through guide bores formed in the rocker arms.

EP 02 65 281 B1 discloses an arrangement for operating inlet and outlet valves of an internal combustion engine with several rocker arms for the opening and closing of the valves and cams for operating the rocker arms which include guide bores to be arranged in alignment with one another. The guide bores have axially movable connecting pins extending across two adjacent rocker arms for their interconnection and are axially movable in the guide bores for selectively disconnecting or joining two adjacent rocker arms.

For general background further reference is made to patent publications DE 42 21 134 C1 and EP 02 93 209 B1.

It is a disadvantage of these arrangements that, because of the short shifting times for the pins, it is necessary to provide relatively large clearances between the support surfaces of the control pins and the guide bores in order to insure movement of the control pins while the guide bores are in alignment with one another. However, the relatively large clearance is problematic insofar as the control pins become cogged when they are disposed between two rocker arms for their interconnection such that the surface area of the pin providing for engagement is relatively small and the high surface pressure caused thereby results in relatively high wear of the engagement areas between the control pin and the guide bores. Furthermore, the relatively large clearance of the control pins in the guide bores causes annoying operating noises of the valve operating mechanism.

A further disadvantage of such an arrangement resides in the fact that, because of the relatively large clearance, the valve overlap has to be relatively large which causes a relatively large amount of combustion gases to remain in the cylinder at the end of the exhaust stroke of the engine.

It is the object of the present invention to provide a valve operating mechanism which, while still providing for reliable operation of the control pin in the aligned position of the guide bores, will permit a reduction of the valve over-lap and will provide therefore for a reduction of the amount of exhaust gases remaining in the cylinder at the end of the exhaust stroke of the engine.

SUMMARY OF THE INVENTION

In an arrangement for operating valves of an internal combustion engine by means of at least two operating members for opening and closing each valve and a camshaft with cams having base portions and camming portions for operating the operating members. The operating members for a valve are disposed in side-by-side relation and have guide bores which ape aligned when the operating members ape disposed on the base portions of the cams. A coupling pin is movable in the guide bores and couples the adjacent operating arms when disposed so as to extend thereacross for movement of said adjacent operating members in unison.

The coupling pin is barrel-shaped with tapered end sections and a center section of a larger diameter which, with the guide bores of the adjacent operating members, forms a cylindrical fit with a clearance of 1–60 μm.

There is only a relatively short period (on the order of a few milliseconds) available for the coupling of the operating arms. The barrel-like coupling pin provides for an advantage insofar as it extends the period for coupling since the coupling procedure can be initiated before the guide bores of the adjacent operating arms are in exact alignment with one another.

A further advantage of the arrangement according to the invention resides in the fact that the barrel-like shape of the coupling pin permits to provide for relatively small clearance between the coupling pin and the walls of the guide bores in the coupling position while still offering high reliability for the coupling operation. As a result of the small clearance and the improved time availability for the coupling process, valve overlap can be reduced whereby the amount of exhaust gases remaining in a cylinder at the end of an exhaust stroke is reduced.

An essential advantage of the arrangement according to the invention is further that slight displacement of the guide bores, such that they are not in exact alignment, can be accommodated by the barrel-like guide pin assuming a slightly inclined position.

Finally, with the arrangement according to the invention the surface pressures are relatively small because of the barrel-like shape of the coupling pin and the small clearance required thereby such that there is only relatively little wear for the engagement sect ions of the coupling pin and guide bores. Also the operating noises generated by a valve operating mechanism utilizing the coupling pin according to the invention is relatively small.

If the guide bores which receive the coupling pins are also convergent, even better coupling periods are obtained. In addition, the surface pressures of the guide pins are relatively small as they engage the convergent portion when compared with a cylindrical coupling pin and any clearance between the coupling pin and the convergent guide bore section can be fully eliminated.

With a barrel-like coupling pin shape and a frusto-conically shaped guide bore by which, upon seating of the coupling pin in the convergent guide bore section, a line contact is established between the coupling pin and the guide bore wall. This makes the surface pressures relatively small and manufacturing of the structure simple. Then the coupling pin engages the guide bore along a circle if no coupling forces are transmitted and along an elliptical line during coupling under load when the coupling pin is slightly tilted.

The arrangement according to the invention can be utilized for all valve operating arrangements with rocker arms that can be coupled and which can be joined and disjoined by means of a slidable control pin, for example, also for valve operating arrangements with valve-disabling provisions.

The drawings show three embodiments of the invention.

DESCRIPTION OF THE PREFERRED EMBODIMENTS

Figure 1:
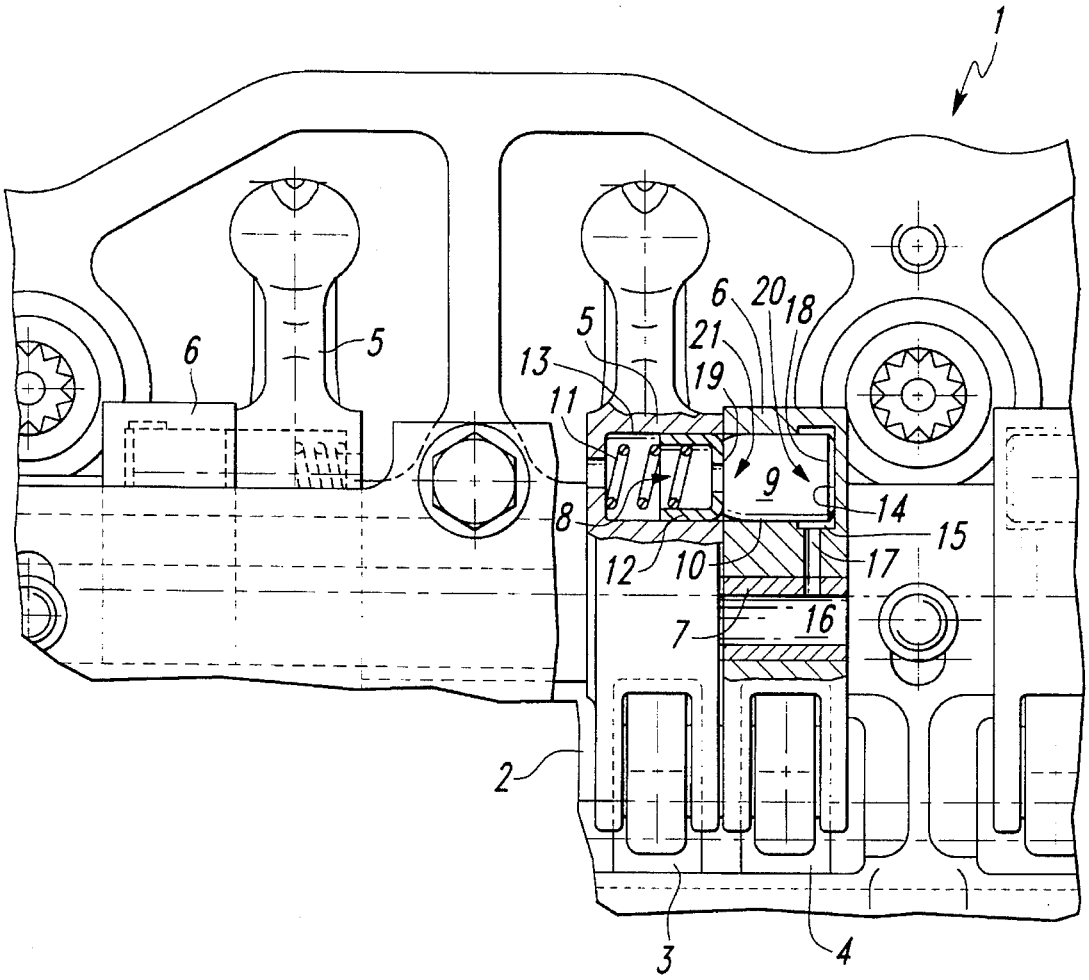
FIG. 1 shows a first embodiment in a top view of a cylinder head of a multi-cylinder internal combustion engine with inlet and outlet valves and with a camshaft having operating members in the form of rocker arms and idler arms for the opening and closing of the valves, wherein coupling or decoupling of the operating members is achieved by means of slidable pins operable by an operating mechanism.

FIG. 1 shows, as known in principle, the inlet valve side of a cylinder head 1 of a multi-cylinder internal combustion engine which is not shown in detail wherein the cylinder head 1 has for each cylinder two inlet valves and two outlet valves which are operated by a camshaft 2 disposed therebetween.

For each inlet valve, the camshaft 2 carries two cams 3 and 4 wherein the cam 3 operates a rocker arm 5 which directly actuates the inlet valve. The other cam 4 operates an idler arm 6 which can be coupled with the rocker arm 5. The rocker arm 5 and the idler arm 6 are provided with rollers R which are engaged by the cams 3, 4 of the camshaft 2.

Rocker arm 5 and idler arm 6 are motion transmitting members for the opening and closing of the inlet valves and are pivotally supported on a support shaft 7. A spring holds the idler arm 6 in contact with the cam 4 even when it is not coupled with the rocker arm 5.

Coupling of rocker arm 5 and idler arm 6 is achieved by means of an operating mechanism 8 capable of operating a barrel-like coupling pin 9 which serves as a coupling member and is movable longitudinally in a guide bore 10 extending parallel to the support shaft 7 within the idler arm 6. The operating mechanism 8 include,s a spring 11 adapted to apply a spring force to the barrel-like coupling pin 9 via a guide cup 12 which is disposed longitudinally movably in a guide bore 13 in the rocker arm 5. The guide bore 13 is in axial alignment with the guide bore 10 of the idler arm when both arms 5 and 6 are abutting their cams 3, 4 at the respective base circles thereof.

For the separation or the coupling of the rocker arm 5 and the idler arm 6 by means of the operating mechanism 8, the coupling pin 9 is selectively movable between the adjacent guide bores 10 and 13.

When the rocker arm 5 and the idler arm 6 are uncoupled, the spring 11 biases the coupling pin 9 toward a stop 14 arranged at its one end remote from the rocker arm 5 so that its other end surface is in the same plane as the abutting side surfaces of the rocker arm 5 and the idler arm 6 and the coupling pin does not extend into the guide bore 13. For the coupling of rocker arm 5 and the idler arm 6, oil under pressure is admitted to a pressure space 15 at the side of the coupling pin remote from the rocker arm 5 by which the coupling pin 9 is moved against the force of the spring 11 partially into the guide bore 13 of the rocker arm 5. Since the cam rise of the cam 4 assigned to the idler arm 6 is higher than the cam rise of the cam 7 assigned to the rocker arm 5, the valve lifting curve for the inlet valve controlled thereby is now determined by the cam 4.

Pressure control in the pressure space 15 is achieved essentially in known fashion via a longitudinal passage 16 in the support shaft 7 which is in communication with the pressure space 15 by a transverse bore 17 in the idler arm 6. The longitudinal passage 16 is supplied with oil by an oil pump via an oil supply pipe including a control valve.

The coupling of rocker arm 5 and idler arm 6 also takes place in an essentially known fashion only at a predetermined rotational speed level of the internal combustion engine and only then when both guide bores 10 and 13 are in alignment with one another.

Figure 2:
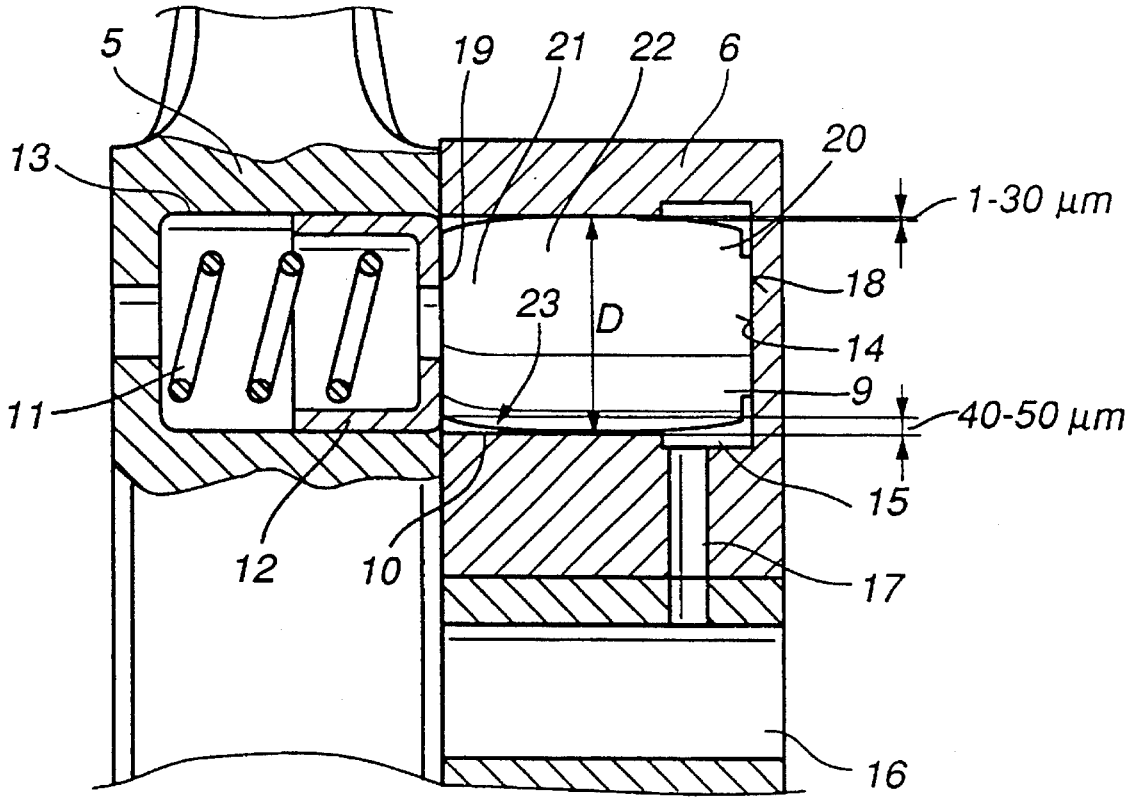
FIG. 2 is an enlarged view of a portion showing the coupling pin and guide bore of FIG. 1 in a position of the coupling pin in which rocker arm and idler arm are disengaged.
Figure 3:
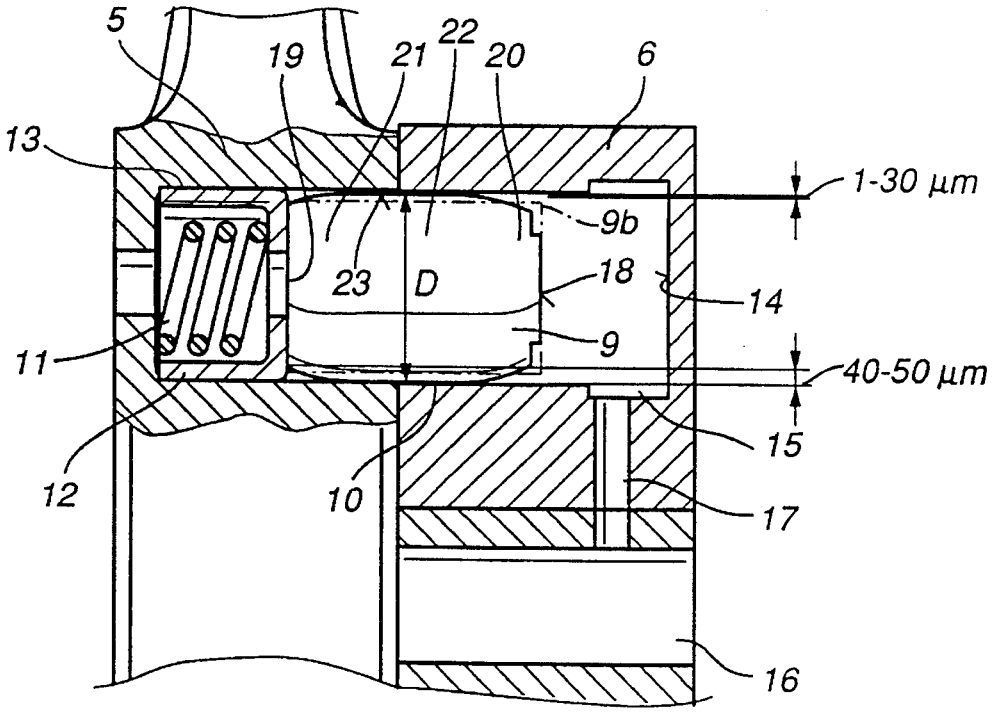
FIG. 3 is an enlarged view of a portion showing the coupling pin and guide bore of FIG. 1 in a position in which rocker arm and idler arm are engaged.
Figure 4:
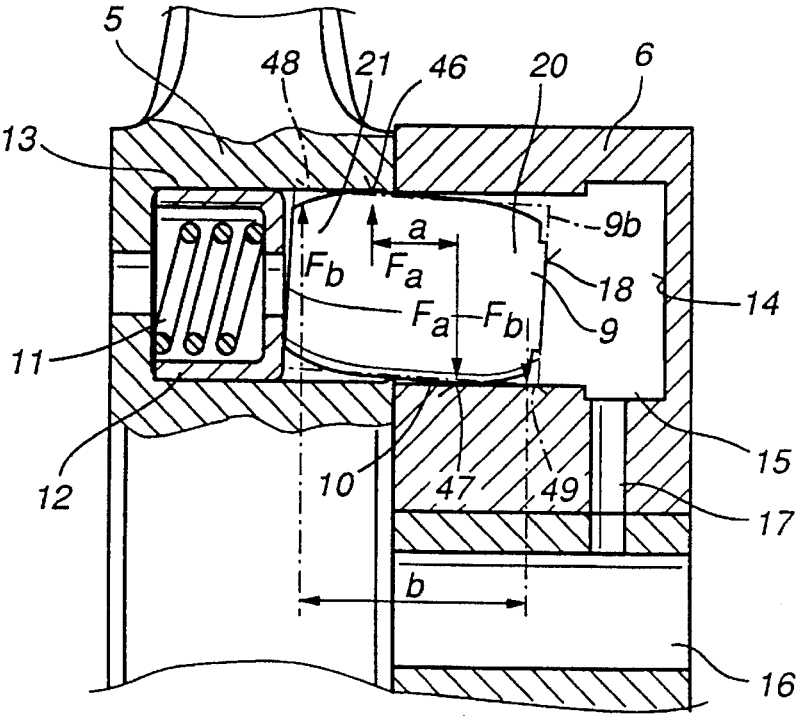
FIG. 4 shows the arrangement of FIG. 3 with the coupling pin somewhat tilted as it is when forces are transmitted during coupling.

FIGS. 2 to 4 show enlarged sections of the arrangement of FIG. 1 including the coupling pin 9 and the guide bores 10 and 13 in a position of the coupling pin 9 in which rocker arm 5 and idler arm 6 are uncoupled (FIG. 2) and in which rocker arm 5 and idler arm 6 are coupled (FIG. 3) and for coupled rocker and idler arms 5 and 6 under load. The same components corresponding to those of FIG. 1 are designated by the same reference numerals.

Between the end sections 20 and 21 the coupling pin 9 has a center section 22 with a diameter D which is the maximum pin diameter. The curvature of the center section 22 of the coupling pin is less than that of the end sections 20 and/or 21. The transition 23 between the center section 22 and the end sections 20 and 21 is smooth, for example, in the form of a convex outer shape, to provide always relatively large contact surface areas. The coupling pin section 22 forms with the guide bores 1O and 13 a cylindrical fit with very little clearance so that, upon coupling of the rocker arm 5 and idler arm 6, only little cogging of the coupling pin 9 in the guide bores 10 and 13 will occur in spite of the transmission of relatively large forces therebetween.

The diameter of the pin 9 at its end face 19 is about 80–100 μm smaller than the diameter of the guide bores 10, 13. The largest diameter of the center section 22 which forms the cylindrical fit with the guide bores 10, 13 is by 1–60 μm smaller than the diameter of the guide bores 10, 13. For optimal setting of the cylinder fit with regard to the coupling process of the coupling pin 9, the pins 9 are individually chosen for best clearance fit with the respective guide bores 10, 13.

For better illustration of the invention, in FIGS. 3 and 4 a coupling pin as known is indicated in dash-dotted lines and marked by reference number **9*b***.

FIG. 3 shows the barrel-shaped coupling pin for coupled rocker arm 5 and idler arm 6 but without force transmission through the coupling pin 9 (**9*b*), that is, at a point of time immediately after coupling. The coupling pin 9 (9*b*) is still in a parallel position with respect to the longitudinal axis of the guide bores 10, 13**.

FIG. 4 shows the barrel-shaped coupling pin in a position like in FIG. 3 but for coupling of the arms under load. It is seen that the coupling pin 9 (**9*b*) is tilted in the guide bores 10, 13 and that force transmission occurs via engagement surfaces 46, 47 of the guide pin 9 or, respectively, engagement surfaces 48, 49 of the coupling pin 9***b*. For illustration, the clearance between the coupling pin 9 and the guide bores 10, 13 is shown larger than it would be according to scale. The same components from FIGS. 2 and 3 are designated by the same reference numerals.

The forces applied to the barrel-shaped coupling pin 9 are indicated by full-line arrows for the force Fa with a lever arm "a" and the forces that would be applied with a cylindrical coupling pin 9*b* are indicated by dash-dotted arrows for the force Fb with a lever arm length b.

As can be seen from FIG. 3, the clearance between the guide bores 10, 13 and 8 cylindrical coupling pin 9*b* is the same over its full length whereas the clearance of the barrel-shaped coupling pin 9 is in the range of the clearance for the cylindrical coupling pin 9*b* only in an area near the circumferential edges of the end faces of the coupling pin but becomes smaller toward the center of the coupling pin. For this reason, a cylindrical coupling pin 9*b* can become cogged to a greater extent than a barrel-shaped coupling 9. At its center, the coupling pin 9 has a larger diameter such that its clearance with respect to the guide bores 10, 13 is preferably only in the range of 1–30 μm as compared to 80–100 μm for a cylindrical coupling pin 9*b*.

The surface pressures between the barrel-shaped coupling pin 9 and the guide bores 10, 13 as generated by the tilting torque effective during force transmission are relatively small already because of the relatively short leverage length a between the force pair Fa compared to the surface pressure between a cylindrical coupling pin 9*b* and the guide bores 10, 13 with a relatively long leverage length b of the force pair Fb. Furthermore, the engagement surfaces 46, 47 of the coupling pin 9 in the form of two barrel shell surface areas are relatively large and more advantageous with regard to wear than the engagement surfaces 48, 49 in the area of the circumferential edges of a cylindrical coupling pin 9*b*.

Figure 5:
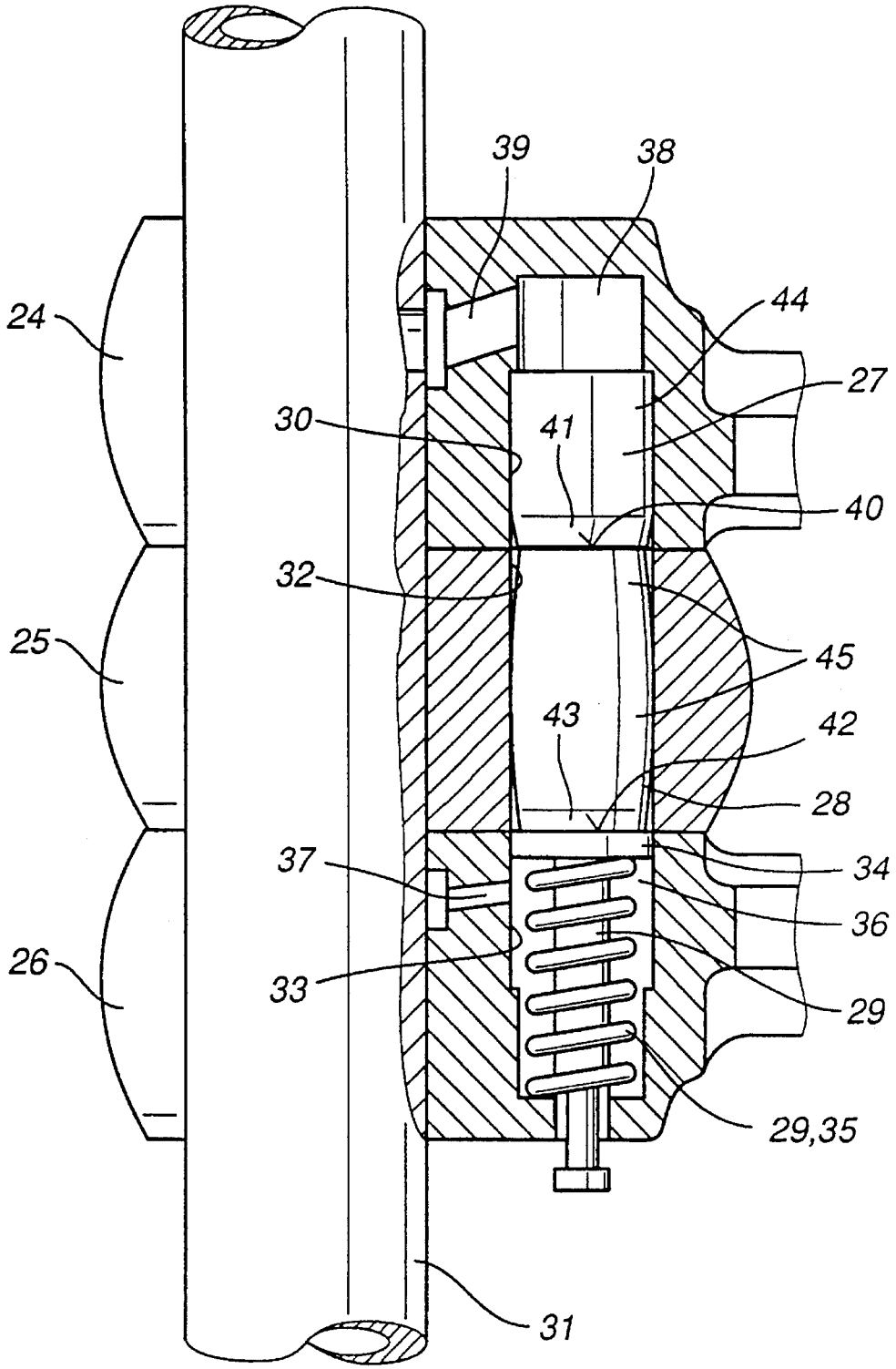
FIG. 5 shows another embodiment of the invention with an arrangement for operating the inlet and outlet valves similar to the arrangement of FIG. 1 but with three arms for opening and closing the valves wherein the arms can be selectively coupled or uncoupled by means of two coupling pins and an operating mechanism.

FIG. 5 shows, for a second embodiment, a section of an arrangement for operating the inlet and outlet valves similar to that of FIG. 2 however with three operating arms 24, 25, 26 for the opening and closing of the valves wherein the arms 24, 25, 26 can be interconnected and disconnected by means of coupling pins 27 and 28 and an operating mechanism 29. The coupling pin 27 is supported in a guide bore 30 which is open toward the second arm 25 and extends parallel to the arm support shaft 31. The second arm 25 has a guide bore 32 in which the barrel-shaped coupling pin 28 is disposed and which also extends parallel to the support shaft 31 and, in the shown position, is in axial alignment with the guide bore 30.

The third arm 26 includes a guide bore 33 which is also in axial alignment with the guide bores 30 and 32 and in which the operating mechanism 29 is disposed.

In the position of the coupling pins 27 and 28 as shown, the arms 24 to 26 are uncoupled from one another (corresponding to FIG. 2). The operating mechanism 29 comprises an operating piston 34 which is biased toward the coupling pin 28 by a spring 35. On the side of the operating piston 34 remote from the coupling pin 28, there is an oil chamber 36 with a control passage 37. Consequently, the operating piston 34 which is biased by the spring 35 can also be operated by pressurized oil supplied through the control passage 35. A second oil chamber 38 with control passage 39 is provided at the end of the coupling pin 27 opposite the coupling pin 28. With the operating mechanism 29 and hydraulic operation of the coupling pins 27, 28 by supplying oil under pressure to the oil chambers 36 and 38, the arms 24, 25 and 26 can be selectively coupled or uncoupled by means of control devices which are known in principle and therefore are not shown or described in detail.

According to FIG. 2, the coupling pin 27 has a front face 40 which is disposed adjacent the coupling pin 28 and from which the end section 41 of the pin 27 extends which, when viewed from the center of the coupling pin 27, tapers down toward the front face 40. Similarly, the coupling pin 28 has an end face 42 adjacent the operating piston 34 from which the coupling pin section 43 extends which, when viewed from the center of the coupling pin 28, tapers down toward the end face 42. The coupling pin 27 is provided with a cylindrical pin section 44 for better guidance and sealing of the oil chamber 38. The surface 45 of the coupling pin 28 however is convex, that is, barrel-like shaped. In the coupled position of the arms 24, 25 and 26 which is not shown in the drawings, the coupling pins 27 and 28 are so displaced that the coupling pins 27, 28 are partially received in the respective end sections of the adjacent guide bores 30, 32 and 32, 33 (similar to FIG. 3).

Figure 6:
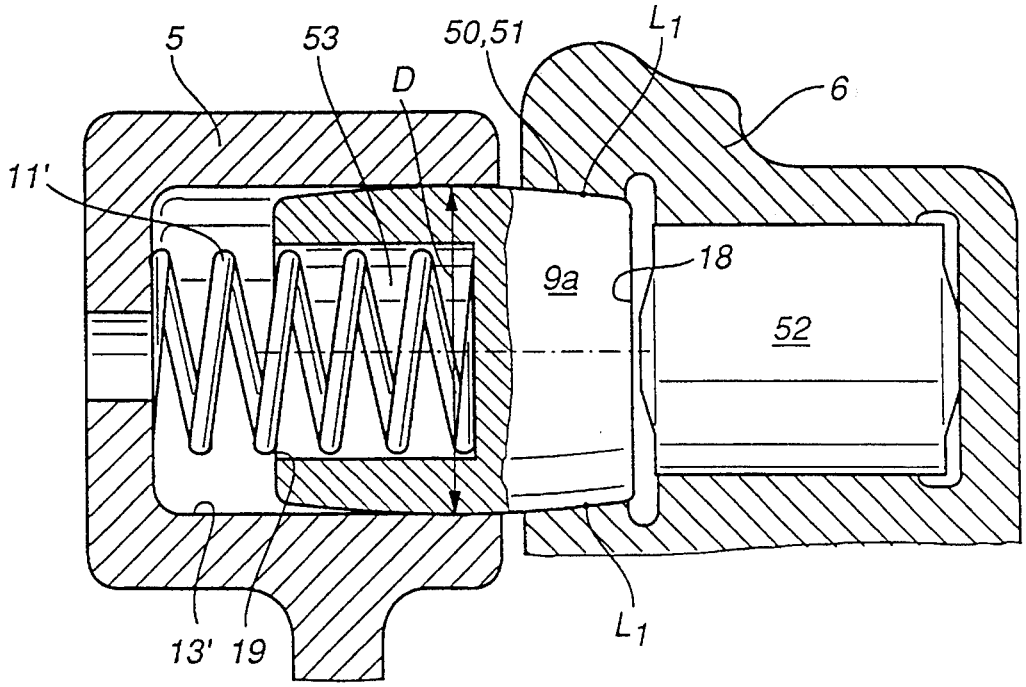
FIG. 6 shows for a third embodiment, an enlarged portion depicting the coupling pin in the shape of a barrel without forces transmitted through the coupling structure.

FIG. 6 shows a third embodiment with a barrel-like coupling pin 9*a* and a guide bore 50 which is tapered inwardly to provide a reception cavity 51 for the coupling pin 9*a* snugly receiving the end of the coupling pin 9*a* during coupling of the adjacent arms. In the arrangement as shown the guide bore 50 is convergent over its full length and has a frusto-conical surface area. No force transmission takes place in the arrangement as shown in FIG. 6 between the rocker arm 5 and the idler arm 6 through the coupling pin. At the right-hand side of the coupling pin 9*a* there is a hydraulic piston 52, which, for uncoupling of the rocker arm 5 from the idler arm 6, presses the coupling pin 9*a* toward the left against the force of the spring 11'. The coupling pin 9*a* has a cavity 53 for receiving the spring 11' which, contrary to the arrangement of FIG. 1 but in a manner known in principle, biases the coupling pin 9*a* toward the idler arm 6 for the coupling of the rocker arm 5 and the idler arm 6. Corresponding components of FIGS. 1 to 5 are designated by the same reference numerals. The coupling pin 9*a* is in contact with the convergent guide bore 50 along a circular line indicated in FIG. 6 by point L1.

Figure 7:
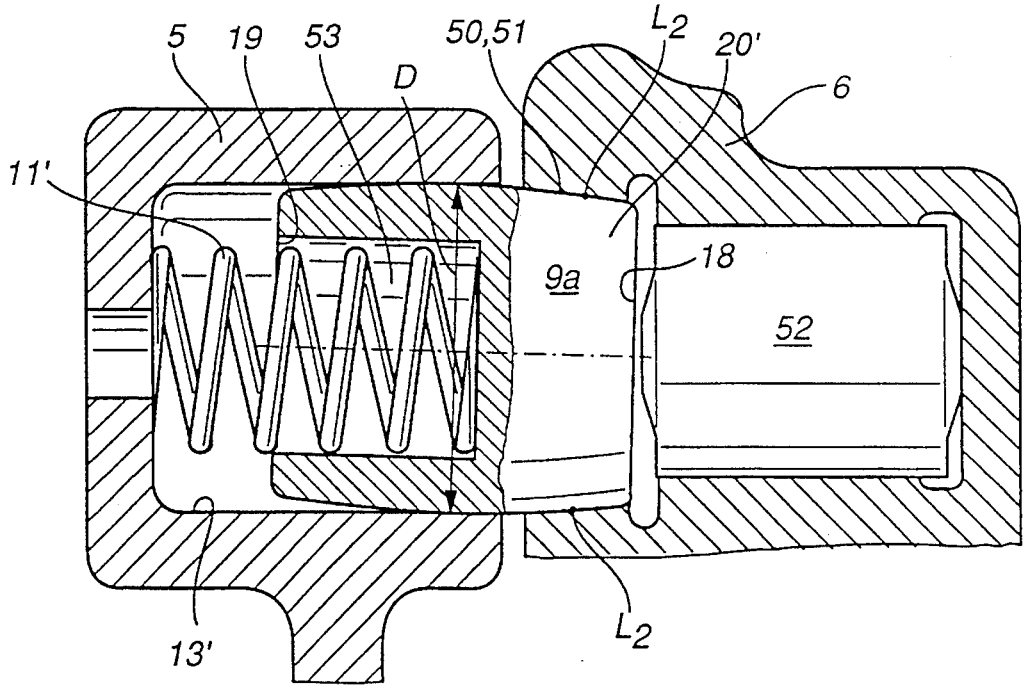
FIG. 7 shows the coupling pin of FIG. 6 with forces transmitted through the coupling arrangement.

FIG. 7 shows the coupling pin 9*a* of FIG. 6 during force transmission between the rocker arm 5 and the idler arm 6 via the coupling pin 9*a*. Corresponding components of FIGS. 1–6 are designated by the same reference numerals. It can be seen that, with a slight tilting of the coupling pin 9*a*, there is a line contact between the coupling pin and the frusto-conical surface of the guide bore 50 which is slightly elliptical whereby surface pressures are substantially reduced as explained earlier. The elliptical contact line is indicated in FIG. 7 by the points L2.

The coupling pin according to the invention is, of course, usable for arrangements wherein the coupling pin is insertable with its opposite ends into either of the guide bores of oppositely adjacent guide bores.

Also, the arrangement described above for use with inlet valves of internal combustion engines may be used in connection with outlet valves in a corresponding manner.

In a further embodiment essentially as shown in FIGS. 6 and 7 of the drawings, a frusto-conical coupling pin forms a non-self-locking conical engagement structure. Operation of the frusto-conical coupling pin can be achieved by an operating arrangement similar to that of FIG. 6. In such an arrangement, the surface pressure between coupling pin and associated guide bore is very small because of the large contact area between coupling pin and guide bore surfaces. Since there is no clearance, the generation of noises in the valve operating mechanism is also relatively low. A non-self-locking conical engagement structure is used in order to facilitate disengagement of the rocker arm 5 and idler arm 6 within the short available operating periods.

What is claimed is:

1. An arrangement for operating valves of an internal combustion engine by means of at least two operating members for opening and closing each of said valves and a camshaft with cams each having a base portion and a camming portion for operating a respective one of said operating members, said at least two operating members being disposed in side-by-side relation and having guide bores so arranged that they are aligned when said operating members are disposed on the base portions of said cams, at least one coupling pin disposed in said guide bores and having opposite end faces, said coupling pin being selectively movable between the guide bores of said adjacent operating members for coupling said adjacent operating members when being disposed in said guide bores so as to extend across said two adjacent operating members, said coupling pin being barrel-shaped providing for end sections which taper down toward said end faces and having a center section of a larger diameter which, with said guide bores, forms a cylindrical fit with a clearance of 1–60 μm, wherein one of said guide bores which receives an end of said coupling pin is convergent in an inward movement direction of said coupling pin into said one guide bore of said adjacent coupling member and said coupling pin is engaged in said one guide bore during coupling of said operating members along a circumferential line of contact.

2. An arrangement according to claim 1, wherein said coupling pin and said convergent guide bore are sized and shaped with respect to one another so that upon seating of the coupling pin in said convergent guide bore, when the operating members are coupled under load, said coupling pin and said guide bore are in contact with each other along the circumferential line of contact.

3. An arrangement according to claim 1, wherein the convergent guide bore has the surface shape of a truncated cone.

4. An arrangement for operating valves of an internal combustion engine by means of at least two operating members for opening and closing each of said valves and a camshaft with cams each having a base portion and a camming portion for operating a respective one of said operating members, said at least two operating members being disposed in side-by-side relation and having guide bores so arranged that they are aligned when said operating members are disposed on the base portions of said cams, at least one coupling pin disposed in said guide bores and having opposite end faces, said coupling pin being selectively movable between the guide bores of said adjacent operating members for coupling said adjacent operating members when being disposed in said guide bores so as to extend across said two adjacent operating members, said coupling pin having a center section with a maximum pin diameter and smaller diameter end sections wherein the diameter of said pin continuously decreases from said center section toward the end faces of said pin so as to define an axially curved convex outer coupling pin surface permitting said coupling pin to tilt slightly during operation while firmly engaging said two operating members.

5. An arrangement according to claim 4, wherein the center section of said pin forms with said guide bores a cylindrical fit with a clearance of 1–60 μm.

6. An arrangement according to claim 4, wherein one of said guide bores which receives an end of said coupling pin is convergent in an inward movement direction of said coupling pin into said one guide bore of said adjacent coupling member and said coupling pin is engaged in said one guide bore during coupling of said operating members along a circumferential line of contact.

7. An arrangement according to claim 6, wherein said coupling pin and said convergent guide bore are sized and shaped with respect to one another so that upon seating of the coupling pin in said convergent guide bore, when the operating members are coupled under load, said coupling pin and said guide bore are in contact with each other along the circumferential line of contact.

8. An arrangement according to claim 6, wherein said convergent guide bore has the surface shape of a truncated cone.

* * * * *